US006406835B1

(12) United States Patent
Kang et al.

(10) Patent No.: US 6,406,835 B1
(45) Date of Patent: Jun. 18, 2002

(54) METHOD FOR MANUFACTURING A PRINTHEAD OF INK JET PRINTING APPARATUS

(75) Inventors: Hung-Chou Kang; Chen-Hua Lin; Ji-Chen Wu, all of Hsinchu (TW)

(73) Assignee: Wisertek International Corporation, Hsinchu (TW)

( * ) Notice: Subject to any disclaimer, the term of this patent is extended or adjusted under 35 U.S.C. 154(b) by 23 days.

(21) Appl. No.: 09/598,841

(22) Filed: Jun. 21, 2000

Related U.S. Application Data

(63) Continuation-in-part of application No. 09/401,264, filed on Sep. 23, 1999.

(30) Foreign Application Priority Data

Jan. 3, 2000 (TW) ..... 88111134A01

(51) Int. Cl.[7] ..... B41J 2/16
(52) U.S. Cl. ..... 430/320
(58) Field of Search ..... 430/320; 347/47, 347/56, 63, 68, 71

(56) References Cited

U.S. PATENT DOCUMENTS 4,558,333 A * 12/1985 Sugitani et al. ..... 346/140 R
5,537,133 A 7/1996 Marler et al. ..... 347/18

* cited by examiner

*Primary Examiner*—John A. McPherson
(74) *Attorney, Agent, or Firm*—Ya-Chiao Chang, Esq.

(57) ABSTRACT

A method according to the invention comprises the following steps. At first, a first layer of film is coated over a micro-control apparatus having a plurality of ejecting elements. Next, a plurality of ink chambers, a plurality of ink channels, and a plurality of supporting cylinders are simultaneously formed in the first layer of film by photolithography. More specifically, the plurality of supporting cylinders is located within the plurality of ink channels. Thereafter, a layer of liquid medium is coated over the first layer of film. A photosensitive film is provided over the first layer of film, and then a plurality of ink orifices is formed therein at positions respectively corresponding to the plurality of ink chambers by photolithography. Finally, the micro-control apparatus is connected to a signal input means. Accordingly, a precision alignment of application between ink orifices and ink chambers in manufacturing a conventional printhead is not necessary so that the throughput and yield rate can be increased.

11 Claims, 5 Drawing Sheets

METHOD FOR MANUFACTURING A PRINTHEAD OF INK JET PRINTING APPARATUS

This application is a continuation-in-part (CIP) of U.S. Ser. No. 09/401,264, filed Sep. 23, 1999. The entire contents of the related application are incorporated herein by reference.

FIELD OF THE INVENTION

The present invention relates to a printhead of an ink jet printing apparatus and its manufacturing method and, more particularly, to a printhead and its manufacturing method of forming ink orifices on a photosensitive film by photolithography (exposure and development).

BACKGROUND OF THE INVENTION

In a conventional thermal bubble printhead, a high temperature is generated by a heating element so that a bubble is generated in the ink within the ink chamber on the heating element. The ink is ejected through an ink orifice by the pressure of the bubble and a dot of ink is printed onto a substrate (such as a sheet of paper). However, to let the bubbles generated by heating adequately eject the ink and form a dot of ink, the ink has to be confined in the ink chamber of the printhead and has to be ejected through a predetermined ink orifice.

A piezoelectric printhead utilizes a piezoelectric material to eject the ink by deforming a film through changing the voltage of an electrode so that the ink is ejected by the film and a dot of ink is printed onto a predetermined substrate through an ink orifice.

The print cartridge of a conventional bubble-type ink jet printing apparatus is shown in FIG. 1. It comprises an ink reservoir 10 and a printhead 12. The ink in the ink reservoir 10 flows through the printhead 12 and is ejected by the printhead 12 onto a substrate. FIG. 2 illustrates the structure of the printhead 12. The printhead 12 comprises a micro-control apparatus 16 formed with a plurality of ejecting elements (i.e. heating elements 14 in accordance with the preferred embodiment of the invention). A photosensitive film (dry film photoresist) 18 is formed on the micro-control apparatus 16. The photosensitive film 18 is used to form ink chambers 20 at locations in alignment with the heating elements 14 by photolithography (exposure and development) so that the ink can flow into the ink chambers 20. The ink orifices 22 is formed in a nozzle plate 24 by electrical forming and the nozzle plate 24 is applied to the dry film photoresist 18 by a way of precision alignment. Therefore, in the assembling process, the ink orifices 22 in the nozzle plate 24 must be in precision alignment with the ink chambers 20 in the photosensitive film 18 respectively so that the ink heated by the heating elements 14 can be ejected through the ink orifices 22. It can be known that this manufacturing process incurs high costs including the tool cost for precision alignment and low quality alignment, assembling, or application of the nozzle plate 24 to the dry film photoresist 18 reduces the yield rate.

Another printhead of a bubble-type ink jet printing apparatus is disclosed in U.S. Pat. No. 5,537,133 and is illustrated in FIG. 3. The printhead 30 comprises a micro-control apparatus 34 formed with a plurality of ejecting elements (i.e. heating elements 32 in accordance with the preferred embodiment of the invention). A photosensitive film (dry film photoresist) 35 is formed on the micro-control apparatus 34. An ink chamber 36 is formed on each of the heating elements 32 by photolithography (exposure and development). Ink orifices 39 are formed in a tape (flexible circuit board) 38, which is attached to the printhead 30 by Tape Automated Bonding (TAB), by laser ablating and the tape 38 is applied to the micro-control apparatus 34 in a way of precision alignment so that each ink orifice 39 and a corresponding ink chamber 36 cooperatively form an ink reservoir for the ink. However, forming ink orifices 39 in tape 38 by laser ablating incurs a high equipment cost that significantly increases the manufacturing cost of the printhead. In addition, low quality alignment and assembling may also reduce the yield rate.

SUMMARY OF THE INVENTION

A primary object of the invention is to provide a printhead and the manufacturing method therefor to thereby prevent ink channels and ink chambers provided in a first layer of film from adhering to a nozzle plate formed by photolithography when the nozzle plate is applied to the first layer of film.

Another object of the invention is to provide a printhead and the manufacturing method therefor to thereby make an electrical connection between signal input means and a micro-control apparatus.

Still another object of the invention is to provide a printhead and the manufacturing method therefor that features the efficacy of precision alignment and high quality assembling so that the yield can be increased and the manufacturing process can be simplified.

Further still another object of the invention is to provide a printhead and the manufacturing method therefor so that the process of manufacturing a printhead can be simplified, the equipment cost can be reduced, and the yield can be increased.

A printhead of an ink jet printing apparatus according to the present invention comprises a micro-control apparatus formed with a plurality of ejecting elements; a first layer of film, formed over said micro-control apparatus, with a plurality of ink chambers formed at positions respectively corresponding to said plurality of ejecting elements, a plurality of ink channels connected with said plurality of ink chambers, and a plurality of supporting cylinders located within said plurality of ink channels; a photosensitive film, formed over said first layer of film, with a plurality of ink orifices formed at positions respectively corresponding to said plurality of ink chambers by photolithography; and a signal input means connected to connected to said micro-control apparatus.

Therefore, the manufacturing process of the printhead in accordance with the present invention is relatively simple. Using this process, the application of a nozzle plate to a photoresist film and the precision alignment between ink orifices and ink chambers in manufacturing a conventional printhead can be avoided so that the throughput and yield rate can be increased.

BRIEF DESCRIPTION OF THE DRAWINGS

The present invention can be further understood with reference to the following description taken in conjunction with the accompanying drawings wherein.

DETAILED DESCRIPTION OF THE PREFERRED EMBODIMENTS

Figure 1:
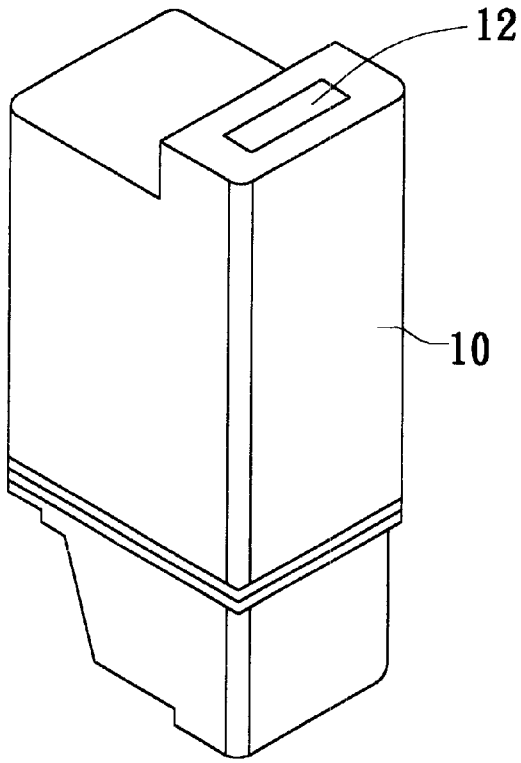
FIG. 1 (PRIOR ART)
FIG. 1 is a pictorial view showing a print cartridge structure of a conventional printer.
Figure 2:
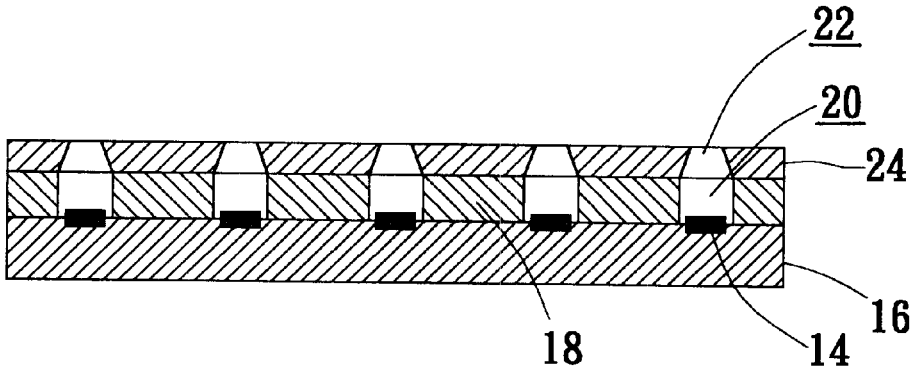
FIG. 2 (PRIOR ART)
FIG. 2 is an enlarged sectional view showing the printhead as shown in FIG. 1.
Figure 3:
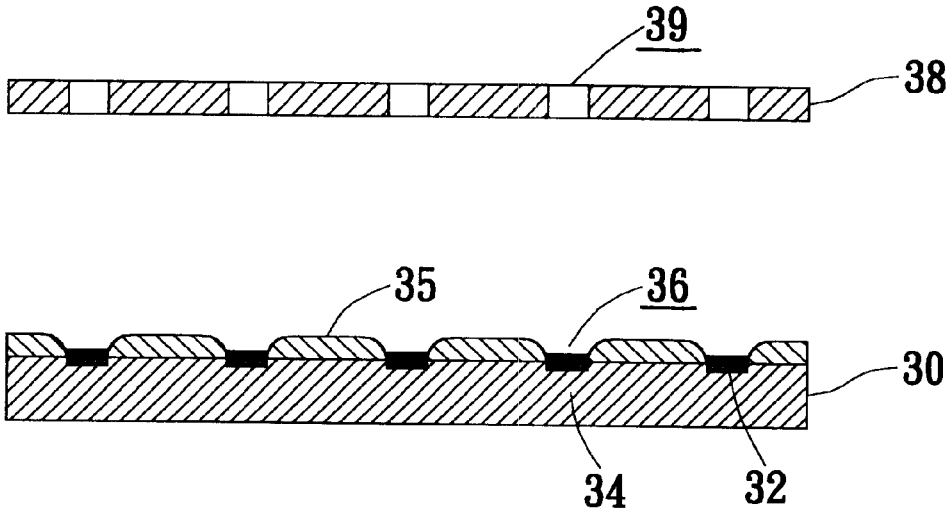
FIG. 3 (PRIOR ART)
FIG. 3 is an enlarged sectional view showing another conventional printhead.
Figure 4:
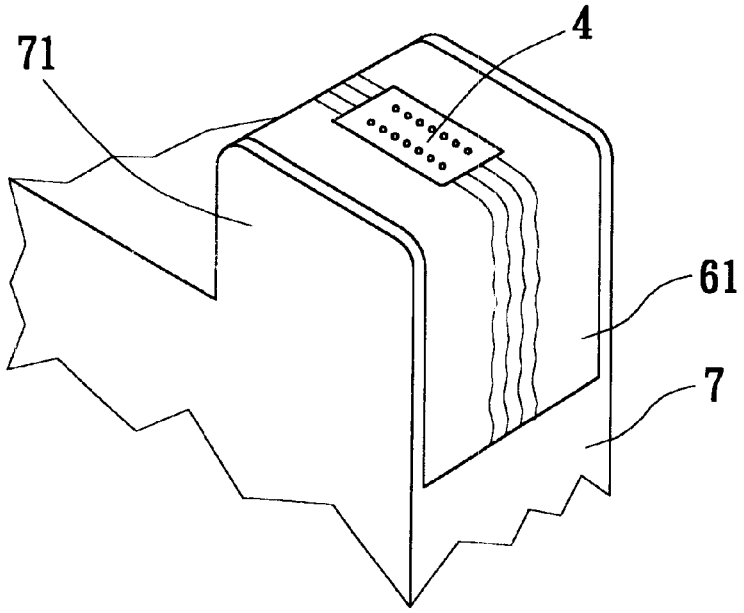
FIG. 4 illustrates a printhead of an ink jet printing apparatus in accordance with a preferred embodiment of the present invention.

Referring to FIG. 4 that illustrates a preferred embodiment of the present invention, a printhead 4 provided at an ink output port 71 of a print cartridge 7 comprises a signal input means (for example, a flexible circuit board) 61. One end of the signal input means 61 is connected to the signal output terminal of the printer (not shown) and the other end is connected to a micro-control apparatus (i.e. an IC chip in accordance with the preferred embodiment of the invention) so that printer signals can be transmitted to the micro-control apparatus to activate the printhead 4. This is well known and will not be further described.

Figure 5:
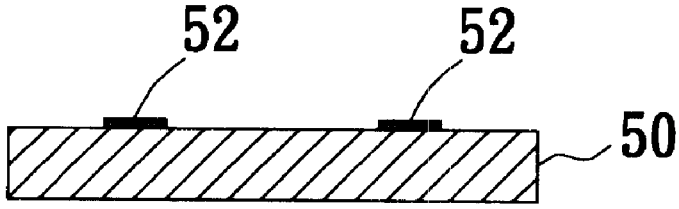
FIG. 5 is a sectional view showing the manufacturing process of a printhead of an ink jet printing apparatus in accordance with a preferred embodiment of the present invention.

Referring to FIG. 5 that illustrates a manufacturing process of a printhead of an ink jet printing apparatus in accordance with a preferred embodiment of the present invention, an electronic circuit is first formed on a substrate ($SiO_2$) by a semiconductor manufacturing process, and this step results in producing a micro-control apparatus 50. Next, a plurality of ejecting elements 52 is formed on the micro-control apparatus 50. Each of the ejecting elements may be a heating means for heating the ink to generate bubbles so as to eject the ink, or may be a piezoelectric material in the form of a film that can be deformed by changing the voltage applied on an electrode and can apply pressure, when it is deformed, on the ink so as to eject the ink through a corresponding ink orifice.

Figure 6:
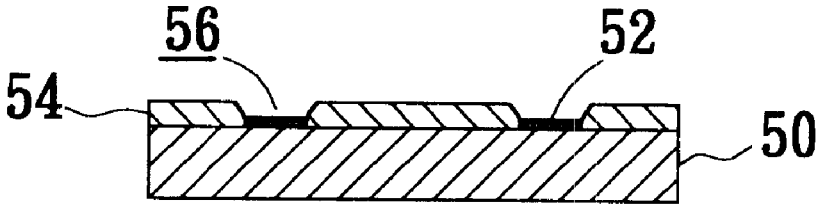
FIG. 6 is a sectional view showing the manufacturing process of a printhead of an ink jet printing apparatus in accordance with a preferred embodiment of the present invention.

Referring to FIG. 6, a liquid photoresist layer (not shown) is coated on the micro-control apparatus 50 (i.e. an IC chip in accordance with the preferred embodiment of the invention), and then a first layer of film 54 is formed on the liquid photoresist layer. The first layer of film 54 is made of a dry film photoresist, which could be positive or negative photoresist, and has a thickness of about 20 to 50 $\mu$m.

Figure 7:
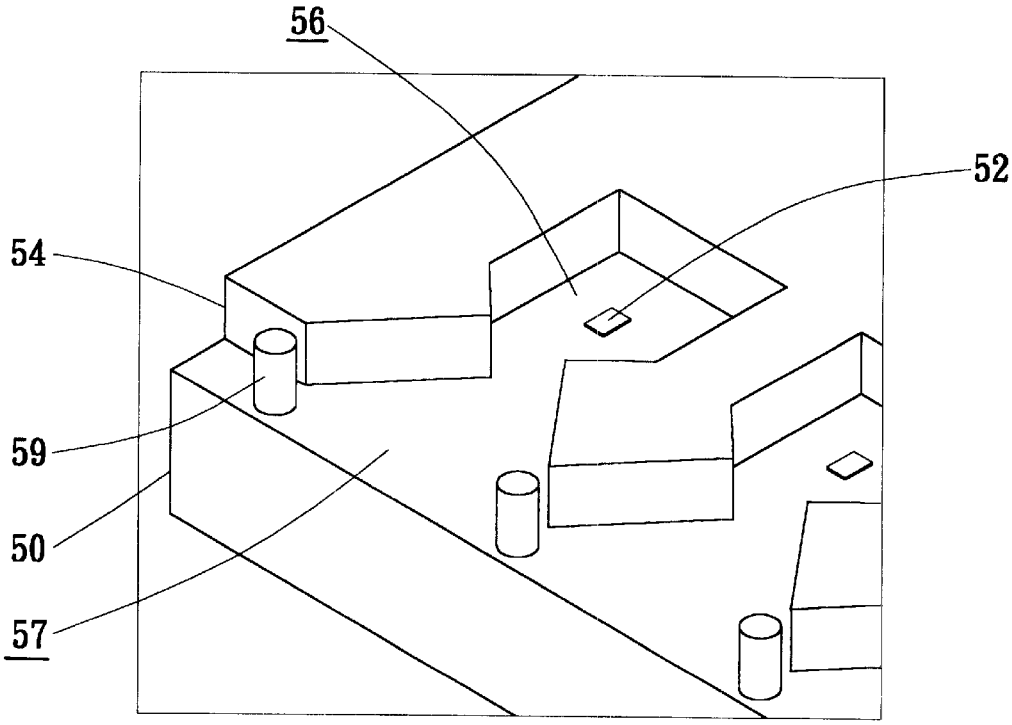
FIG. 7 is a top view of FIG. 6.

Referring to FIG. 7 in addition to FIG. 6, a concave ink chamber 56 and an ink channel 57 are formed in the first layer of film 54 in alignment with each of the ejecting elements 52 provided on the micro-control apparatus 50 by photolithography (exposure and development) so that the ink can flow into the ink chamber 56 through the ink channel 57. In addition, a plurality of supporting cylinders 59 is simultaneously formed within the ink channels 57 by photolithography (exposure and development). At this moment in time, the liquid photoresist layer is used to make the plurality of supporting cylinders reliably formed on the micro-control apparatus 50.

Figure 8:
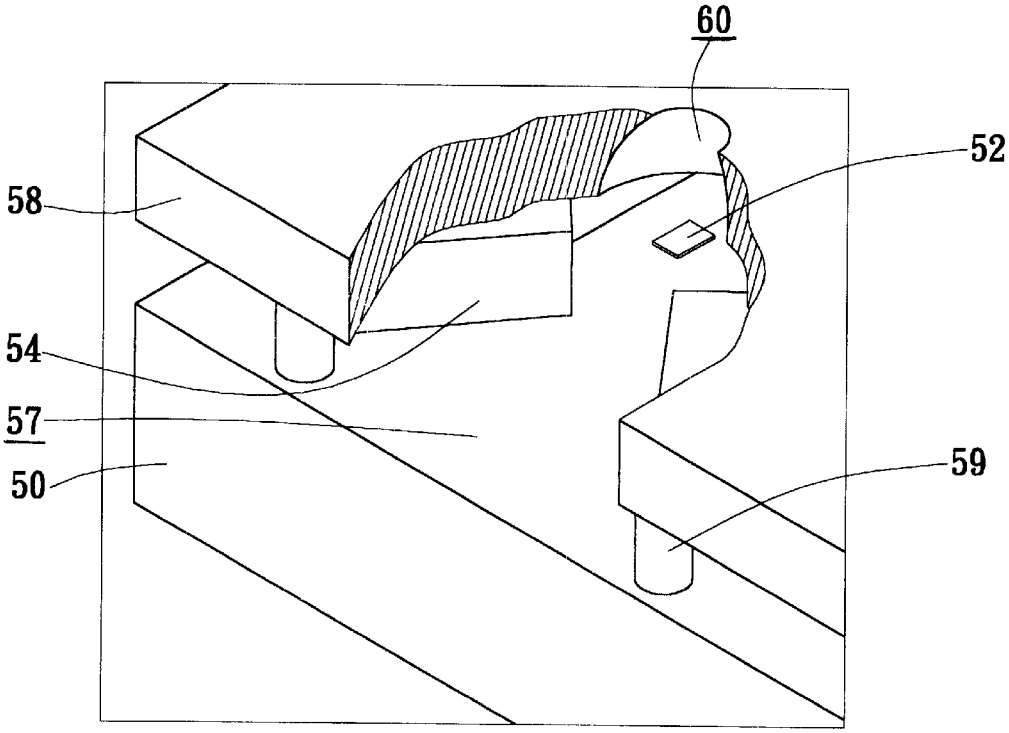
FIG. 8 is a sectional view showing the manufacturing process of a printhead of an ink jet printing apparatus in accordance with a preferred embodiment of the present invention.

Referring to FIG. 8, a layer of liquid medium (not shown) is coated over the first layer of film 54. In the preferred embodiment, the liquid medium is a water solution, for example. Next, a photosensitive film 58 made of positive-type dry film photoresist is applied and coated over the first layer of film 54 by a process of roller pressing. At this moment in time, the layer of liquid medium is pressed into the ink chambers 56 and the ink channels 57 to thereby prevent the photosensitive film 58 from filling the ink channels 57 and adhering to the micro-control apparatus 50 during the process of roller pressing. In addition, the supporting effect provided by the supporting cylinders 59 also prevents the photosensitive film 58 from filling the ink channels 57 and adhering to the micro-control apparatus 50. Subsequently, a plurality of ink orifices 60 is formed in the photosensitive film 58 at positions respectively corresponding to the ink chambers 56 formed in the first layer of film 54 by photolithography (exposure and development). In the preferred embodiment, the process of photolithography is carried out by dry or wet etching.

Therefore, each of the ink orifices 60 formed in the photosensitive film 58 by exposure and development is in precision alignment with a corresponding ink chamber 56 formed in the first layer of film 54. Accordingly, the precision alignment between the ink chambers 56 and the corresponding ink orifices 60 in the assembling process is simplified with a result in increasing the yield rate of production. Moreover, due to the simplification, the equipment costs incurred by electrical forming, laser ablating, and precision alignment can be saved to significantly reduce the manufacturing cost.

Figure 9:
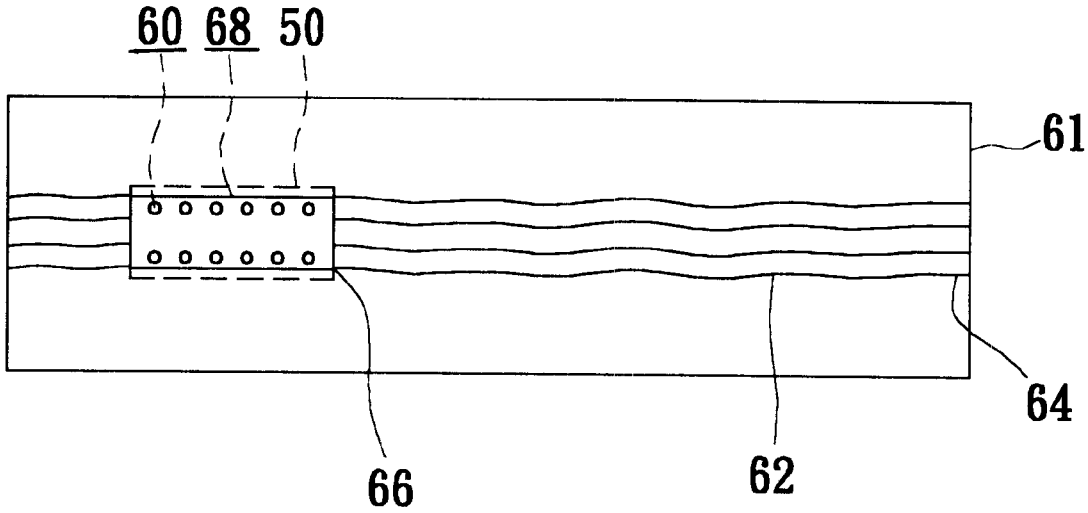
FIG. 9 is a sectional view showing the manufacturing process of a printhead of an ink jet printing apparatus in accordance with a preferred embodiment of the present invention.

Referring to FIG. 9, a signal input means 61, which is a flexible circuit board in the preferred embodiment, is provided with an electrical connecting signal wiring 62. One end of the electrical connecting signal wiring 62 is a signal output terminal 64 connected to a printer, and the other end is a signal output terminal 66 connected to the micro-control apparatus 50 so that printer signals can be transmitted to the micro-control apparatus 50 to activate the printhead. Furthermore, the signal input means 61 is provided with an opening 68 having an appropriate size for exposing the micro-control apparatus 50. Moreover, the size of the opening 68 is smaller than that of the micro-control apparatus 50 in such a way that the signal input means 61 can be adhered to the micro-control apparatus 50 by applying adhesive glue.

A printhead according to the present invention primarily comprises the following elements. A micro-control apparatus 50 is provided with a plurality of ejecting elements 52. A first layer of film 54 made of dry film photoresist with a plurality of ink chambers 56, a plurality of ink channels 57, and a plurality of supporting cylinders 59 located within the plurality of ink channels 57 is formed on the micro-control apparatus 50 by photolithography (exposure and development). A photosensitive film 58 made of dry film photoresist with a plurality of ink orifices 60 at positions respectively corresponding to the plurality of ink channels 56 is formed over the first layer film 54. A signal input means 61, which is a flexible circuit board, is provided with an electrical connecting signal wiring 62, one end of which is a signal output terminal 64 connected to a printer and the other end of which is a signal output terminal 66 connected to the micro-control apparatus 50 so that printer signals can be transmitted to the micro-control apparatus 50 to activate the printhead.

It can be easily understood that forming ink orifices in accordance the manufacturing method of the present invention by photolithography (exposure and development) does not need the precision alignment and forming of ink orifices by laser ablating or electrical forming in a conventional printhead manufacturing process. Therefore, the equipment cost can be significantly reduced. Furthermore, forming ink orifices in a photoresist film by photolithography (exposure and development) can achieve the precision alignment to thereby improve the yield rate of production.

Although the preferred embodiments of the invention have been illustrated and described, it will be obvious to those skilled in the art that various modifications may be made without departing from the scope and spirit of the invention defined by the appended claims.

What is claimed is:

1. A method for manufacturing a printhead of an ink jet printing apparatus comprising the following steps:

providing a micro-control apparatus having a plurality of ejecting elements;

forming on the micro-control apparatus a first layer of film provided with a plurality of ink chambers and a plurality of ink channels;

coating a layer of liquid medium on the first layer of film;

forming a photosensitive film on the first layer of film;

forming a plurality of ink orifices in the photosensitive film by photolithography at positions respectively corresponding to the plurality of ink chambers provided in the first layer of film; and connecting the micro-control apparatus to a signal input means.

2. A method according to claim 1, wherein the first layer of film is made of dry film photoresist, and the plurality of ink chambers and the plurality of ink channels are formed in the first layer of film at positions over the plurality of ejecting elements.

3. A method according to claim 1, wherein the liquid medium is a water solution.

4. A method according to claim 1, wherein the photosensitive film is made of dry film photoresist.

5. A method according to claim 1, further comprising a step of forming a plurality of supporting cylinders located within the plurality of ink channels.

6. A method according to claim 5, wherein the plurality of supporting cylinders, ink chambers, and ink channels are simultaneously formed in the first layer of film by photolithography.

7. A method according to claim 1, wherein the signal input means is a flexible. circuit board provided with an opening having an appropriate size smaller than that of the micro-control apparatus for accommodating the micro-control apparatus.

8. A method for manufacturing a printhead of an ink jet printing apparatus comprising the following steps:

forming a micro-control apparatus having a plurality of ejecting elements;

coating on the micro-control apparatus a liquid photoresist layer;

forming on the liquid photoresist layer a first layer of film provided with a plurality of ink chambers, a plurality of ink channels, and a plurality of supporting cylinders;

forming a photosensitive film over the first layer of film;

forming a plurality of ink orifices in the photosensitive film by photolithography at positions respectively corresponding to the plurality of ink chambers provided in the first layer of film; and connecting the micro-control apparatus to a signal input means.

9. A method according to claim 8, further comprising a step of coating a layer of liquid medium on the first layer of film after said step of forming the first layer of film provided with the plurality of ink chambers, the plurality of ink channels, and the plurality of supporting cylinders.

10. A method according to claim 8, wherein the plurality of supporting cylinders, ink chambers, and ink channels are simultaneously formed in the first layer of film by photolithography.

11. A method according to claim 9, wherein the signal input means is a flexible circuit board provided with an opening having an appropriate size smaller than that of the micro-control apparatus for accommodating the micro-control apparatus.

* * * * *